US005716764A

United States Patent [19]

Rieger et al.

[11] Patent Number: 5,716,764

[45] Date of Patent: Feb. 10, 1998

[54] PHOTOGRAPHIC SILVER HALIDE ELEMENT HAVING IMPROVED STORAGE STABILITY

[75] Inventors: John Brian Rieger, Rochester; Charles Leo Bauer, Webster, both of N.Y.

[73] Assignee: Eastman Kodak Company, Rochester, N.Y.

[21] Appl. No.: 631,318

[22] Filed: Apr. 10, 1996

[51] Int. Cl.[6] ..... G03C 11/00

[52] U.S. Cl. ..... 430/372; 430/504; 430/507; 430/510; 430/517; 430/522; 430/559; 430/551; 430/607; 430/609; 430/627

[58] Field of Search ..... 430/504, 507, 430/510, 517, 522, 559, 551, 607, 609, 627, 372

[56] References Cited

U.S. PATENT DOCUMENTS 5,460,930 10/1995 Merkel et al. ..... 430/504

*Primary Examiner*—Geraldine Letscher
*Attorney, Agent, or Firm*—Arthur E. Kluegel

[57] ABSTRACT

The invention provides a multilayer silver halide color negative photographic element comprising in the same layer a cyan dye of formula (I) and a ballasted stabilizer compound of formula (II), where the respective formulas are:

(I)

and

B—L—A—R (II)

wherein:

the substiuents are as defined herein the specification.

21 Claims, No Drawings

PHOTOGRAPHIC SILVER HALIDE ELEMENT HAVING IMPROVED STORAGE STABILITY

FIELD OF THE INVENTION

This invention relates to a multilayer silver halide photographic element containing in the same layer a naphtholic cyan dye of formula (I) and a ballasted stabilizer of formula (II). Such an element exhibits improved storage stability.

BACKGROUND OF THE INVENTION

Modern color negative films usually contain dyes coated in one or more layers for a variety of purposes. In addition to being utilized for spectral sensitization, dyes may be used for other purposes such as filtering specific wavelengths of exposing light (either as intergrain absorbers or in separate layers containing no silver halide), for antihalation and for adjusting the background density (Dmin) of color negative films for printing purposes. Such preformed coated dyes (that is, dyes which are present in the element prior to exposure and development) are often referred to as "dummy dyes" to distinguish them from dyes that are formed photographically as a result of exposure and chromogenic development.

In the development of color photographic elements, bleach solutions are used to oxidize developed silver to silver ions for subsequent removal in fix solution by formation of soluble silver complexes. The bleach and fix solutions are sometimes combined into a single "blix" solution. Bleach solutions commonly contain complexes of ferric ion, such as ferric ethylenediaminetetraacetic acid (EDTA), as oxidizing agents. Prolonged use of such solutions for processing of photographic film can result in accumulation of substantial quantities of the corresponding ferrous ion complexes (such as ferrous EDTA), which can function as reducing agents. These reducing agents can cause reductive discoloration of dummy dyes (so called leuco dye formation). The formation of leuco dye in such seasoned bleaches is undesirable, not only because the resulting Dmin density provided by the dummy dye will be less than the optimum required for proper printing characteristics, but also because variabilities in Dmin can occur as seasoning of a bleach progresses.

Many cyan dyes that have been used in color negative films for antihalation and for Dmin adjustment have suffered from a number of deficiencies, including loss of color in seasoned photographic bleach solutions or in bleaches of low oxidizing strength. Additionally, they may also have improper hue or suffer from changes in hue and/or density upon storage at low or high temperatures. For example, the dye of structure:

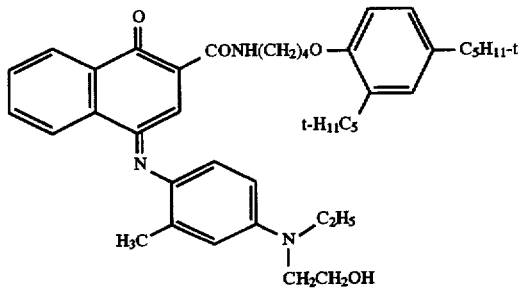

has been used extensively in a number of commercial color negative films. The hue of this dye is suitable for Dmin adjustment and for antihalation purposes. However, this dye can undergo reductive discoloration when films containing it are processed in seasoned photographic bleaches or in bleaches of weak oxidizing power.

Merkel et al., U.S. Pat. No. 5,460,930 proposes an improved naphtholic dye which exhibits less tendency to undergo leuco dye formation in seasoned bleaches or weak bleaches. However, dyes having the formula of the Merkel patent and dyes similar thereto exhibit an undesirable storage instability or keeping problem. These dyes cause elevated minimum density (Dmin), particularly when the element containing the dye is subjected to high temperatures or long storage times.

It is a problem to be solved to provide a multilayer photographic element containing naptholic cyan dyes of either of the types described which have improved storage stability.

SUMMARY OF THE INVENTION

The invention provides a multilayer silver halide color negative photographic element comprising in the same layer a cyan dye of formula (I) and a ballasted stabilizer compound of formula (II), where the respective formulas are:

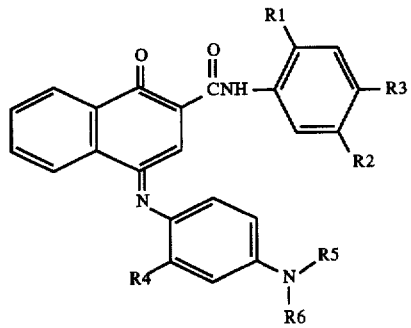

(I)

wherein:

R1 is selected from the group consisting of an alkoxy group, a phenoxy group and a halogen atom;

R2 is selected from the group consisting of hydrogen, an alkyl group, a phenyl group; a halogen atom, an alkoxy carbonyl group of formula —COOR7, and a carbonamido group of formula —NR8COR7;

R3, R4, R5 and R8 are independently selected from the group consisting of hydrogen and an alkyl group;

R6 is an alkyl group; and

R7 is an alkyl group or a phenyl group;

and

B—L—A—R (II)

wherein:

B is a ballast group;

L is a divalent linking group;

A is a group of the formula:

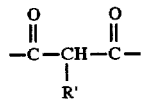

(III)

wherein

R' is hydrogen or an alkyl or alkoxy group; and

R is hydrogen or an aliphatic or aromatic group linked directly or through a nitrogen or oxygen atom to A.

The invention also provides a method of forming a color negative image on a transparent support using the element of the invention and a process for obtaining a positive image by using an exposed and developed negative element of the invention to optically print a positive image onto a second color. negative element.

DETAILED DESCRIPTION OF THE INVENTION

A typical multicolor photographic element useful for optical printing comprises a transparent support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one, yellow dye-forming coupler. The element can contain additional layers, such as filter layers, interlayers, overcoat layers, subbing layers, and the like.

With the color negative element of the invention, the processing step described above provides a negative image. The described elements can be processed in the known Kodak C-41 color process as described in The British Journal of Photography Annual of 1988, pages 191–198. Such negative working emulsions are typically sold with instructions to process using a color negative method such as the mentioned C-41 process.

The photographic element of this invention comprises one or more of the nondiffusing cyan dyes of the formula:

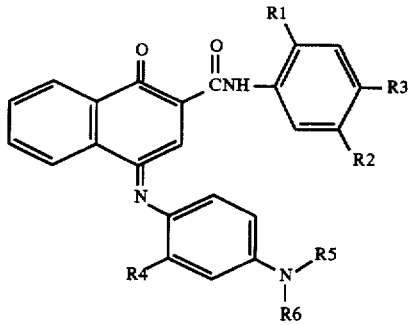

(I)

wherein:

R1 is an alkoxy group, a phenoxy group or a halogen atom;

R2 is hydrogen, an alkyl group, a phenyl group; a halogen atom, an alkoxy carbonyl group of formula —COOR7, or a carbonamido group of formula —NR8COR7;

R3, R4, R5 and R8 are independently hydrogen or an alkyl group;

R6 is an alkyl group; and

R7 is an alkyl group or a phenyl group.

These dyes may be employed in any layer of the photographic element but are typically employed in non-light sensitive layers and, where it is desired to maximize the speed of the red light sensitive layers, below one or more of the red light sensitive layers. The dummy dye may be, for example, in a layer adjacent to and on either the top sensitized layer side of the transparent support or on the bottom or side opposite the sensitized layers. By reference to the terms "under", "above", "below" or the like it is assumed that the element is oriented with the sensitized layers above the support so that the incident light resulting in the original image is from the top of the element.

R1 in the above formula may optionally be restricted to an unbranched alkoxy group (which itself may be restricted to unbranched and unsubstituted alkoxy), a phenoxy group or a halogen. The cyan dummy dye may be selected so as to not have any acid or acid salt groups present (such as —$SO_3H$, —COOH or their salts). In particular, R1, R2 and R3 may be selected such that they do not have an an acid or acid salt group present (particularly, they do not have —$SO_3H$, —COOH or their salts present). Alternatively, R1 may be an alkoxy group (which by the definition above, includes both branched and unbranched groups) while R2 is an unsubstituted alkyl and R3 is hydrogen.

To produce a nondiffusable dye of low water solubility, the total number of carbon atoms in R1, R2 and R3 taken together should be at least 8 and preferably from 10 to 30. Suitably R4 is methyl, R5 is ethyl and R6 is either ethyl, beta-hydroxyethyl or beta- (methylsulfonamido)ethyl, since then the dye may be synthesized from commonly used developing agents.

The photographic elements of this invention can have the cyan dummy dyes of the type described above, incorporated in them by first dispersing an oil phase containing the dye in an aqueous phase containing a binder, such as gelatin, and one or more surfactants. The dye-containing dispersion is then coated in the appropriate layer of a multilayer film on a suitable support. The oil phase usually consists of the dye dissolved in one or more high-boiling solvents. This is typically added to an aqueous solution of gelatin and surfactant, which is followed by milling or homogenization of the mixture to disperse the oil phase in the aqueous phase as small droplets. Removable (by washing or evaporation) auxiliary solvents, such as ethyl acetate or cyclohexanone, may also be used in the preparation of such dispersions to facilitate dissolution of the dye in the oil phase.

High-boiling solvents useful for the practice of this invention include aryl phosphates (e.g. tritolyl phosphate), alkyl phosphates (eg. trioctyl phosphate), mixed aryl alkyl phosphates (e.g. diphenyl 2-ethylhexyl phosphate), aryl, alkyl or mixed aryl-alkyl phosphonates, phosphine oxides (e.g. trioctylphosphine oxide), esters of aromatic acids (e.g. dibutyl phthalate), esters of aliphatic acids (eg. dibutyl sebecate), alcohols (e.g. 2-hexyl-1-decanol), phenols (e.g. p-dodecylphenol), carbonamides (e.g. N,N-dibutyldodecanamide or N-butylacetanalide), sulfoxides (e.g. bis(2-ethylhexyl)sulfoxide), sulfonamides (e.g. N,N-dibutyl-p-toluenesulfonamide) or hydrocarbons (e.g. dodecylbenzene). Additional high-boiling solvents and auxiliary solvents are noted in the Research Disclosure references below. Useful dye:high-boiling solvent weight ratios range from about 1:0.1 to 1:10, with 1:0.3 to 1:5.0 being preferred.

The above described cyan dummy dyes may be coated in the photographic elements of this invention together with other dyes or addenda in the same layer or layers. In the photographic elements of this invention the cyan dyes are typically coated under at least one of the red-sensitive layers in a multilayer film. It is most common to coat these cyan dummy dyes in a layer adjacent to the transparent film support and under all of the red-sensitive layers of a multilayer film. However, the described cyan dummy dyes may also be coated under the support on the side of the support opposite the side on which the light-sensitive emulsion-containing layers are coated. In photographic elements of the present invention, the above described cyan dummy dyes may also be conveniently coated in one or more of the lower silver halide containing red-sensitive layers of a multilayer film containing more than one red-sensitive layer. Useful coated levels of the cyan dummy dyes of this invention range from about 0.002 g/sq m to 0.150 g/sq m, with coated levels ranging from 0.004 g/sq m to 0.050 g/sq m being typical).

To make photographic elements of the present invention, a layer containing a cyan dummy dye of the above described type is formed. Preferably, as described above, at least one red-sensitive layer is typically formed above the cyan dummy dye containing layer, which red-sensitive layer contains a cyan dye forming coupler which forms a cyan dye upon exposure and processing of the element. In a known manner, further layers or additives may be provided in the photographic element as described herein or which are known.

Examples of cyan dummy dyes of this invention include but are not limited to the following (D1–D24):

D1

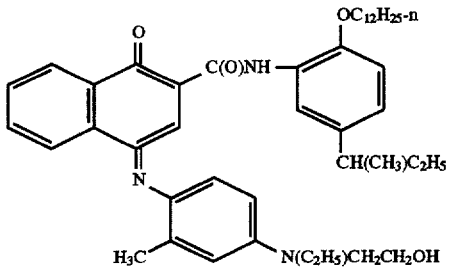

D2

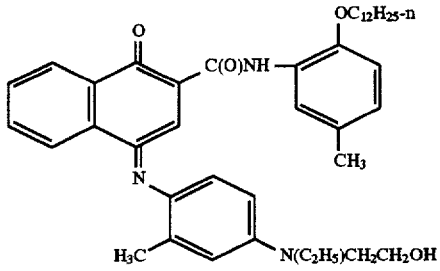

D3

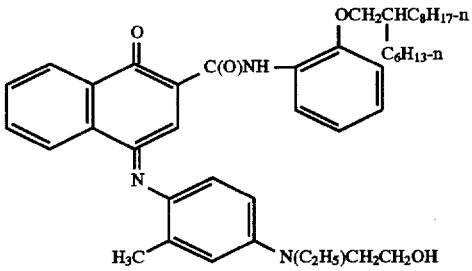

D4

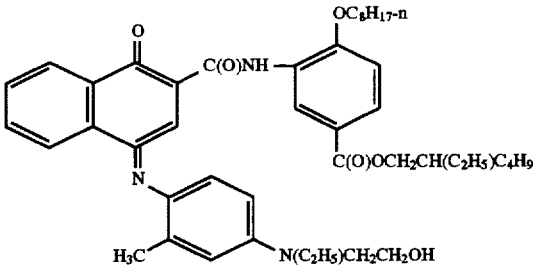

D5

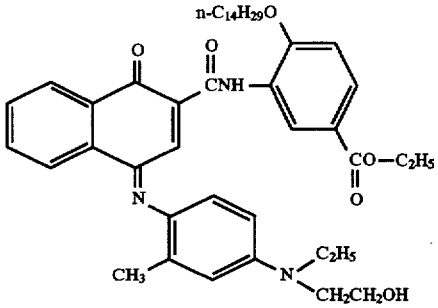

D6

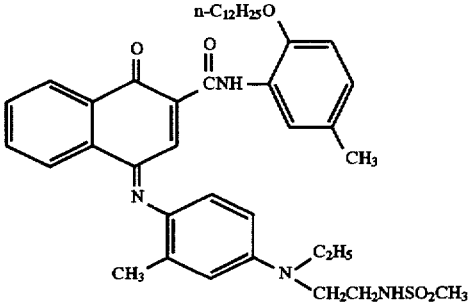

D7

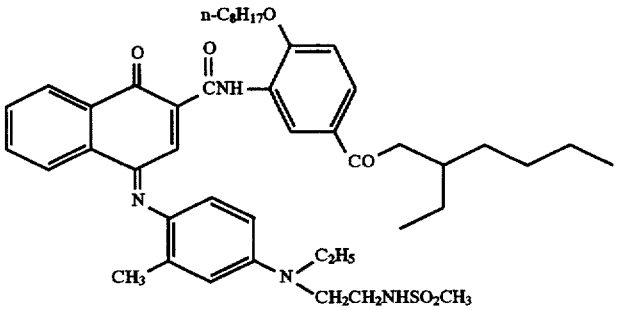

-continued
D8
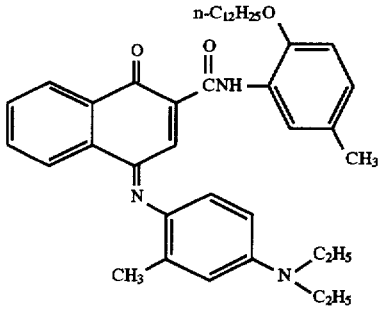
D9
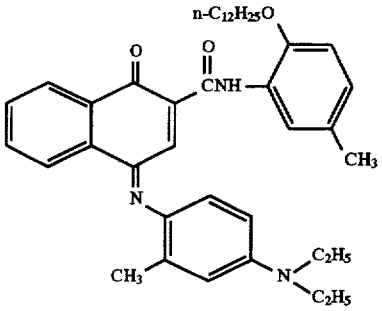
D10
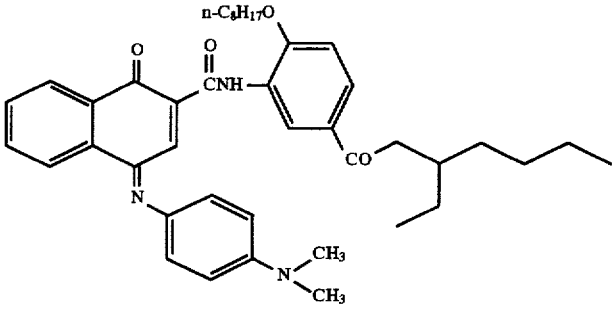
D11
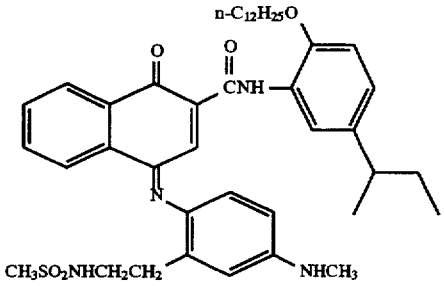
D12
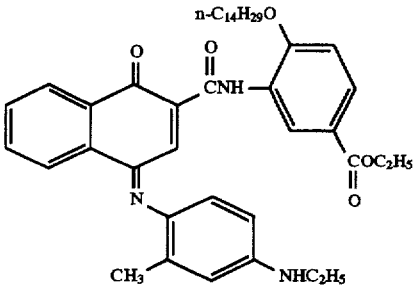
D13
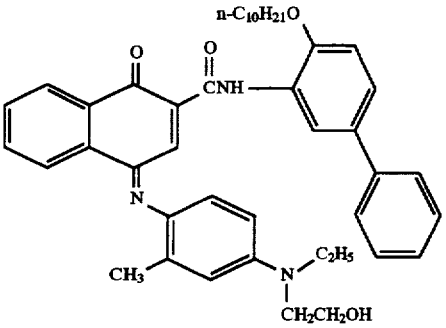
D14
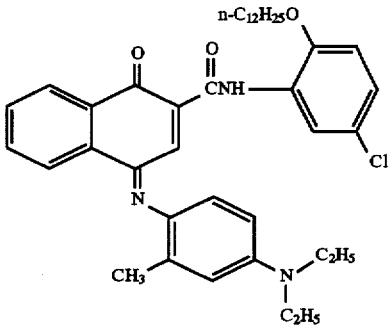

-continued
D15
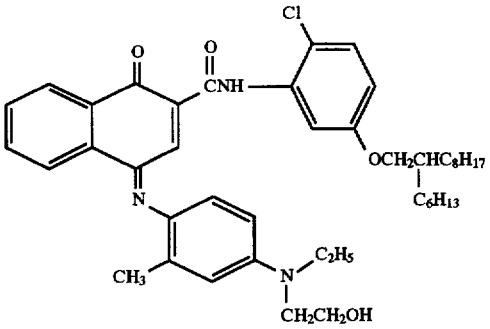
D16
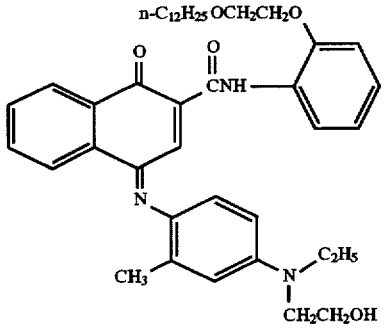
D17
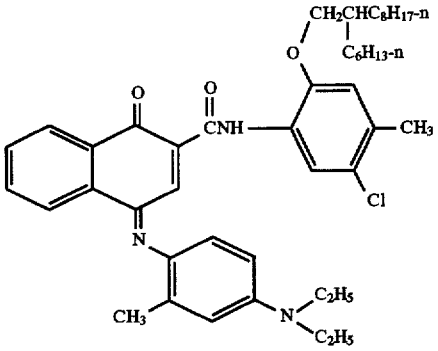
D18
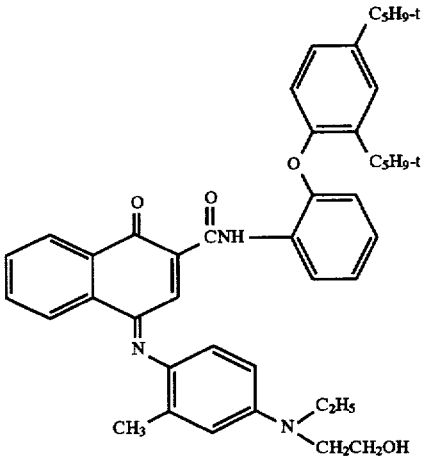
D19
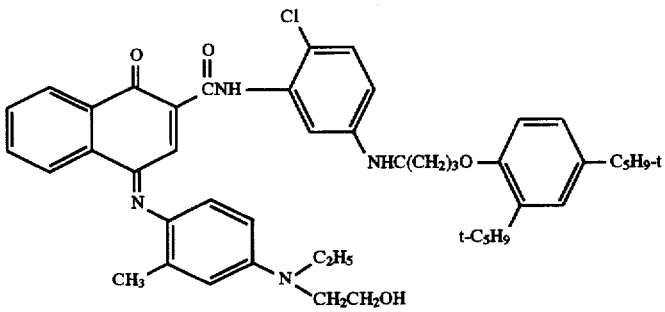
D20
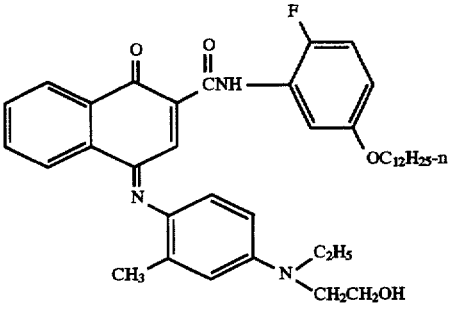
D21
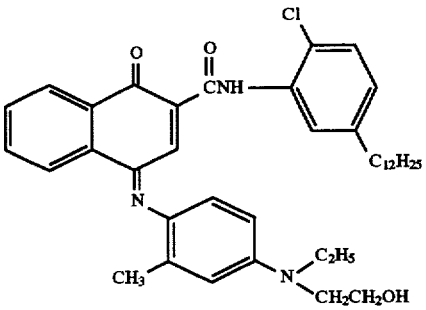

-continued

D22

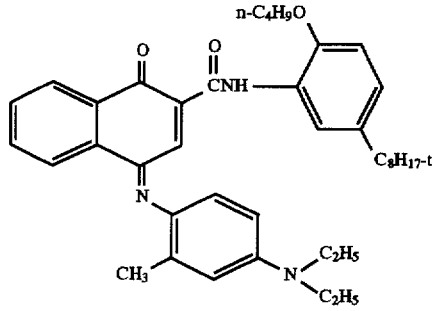

D23

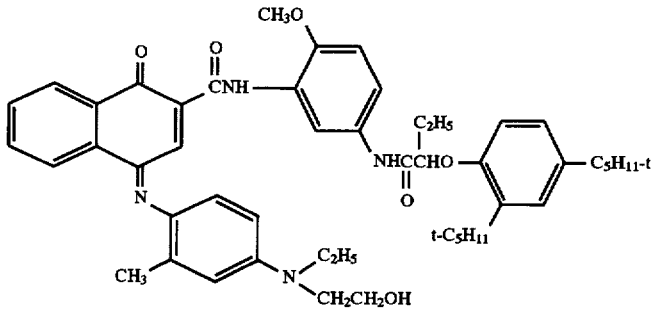

D24

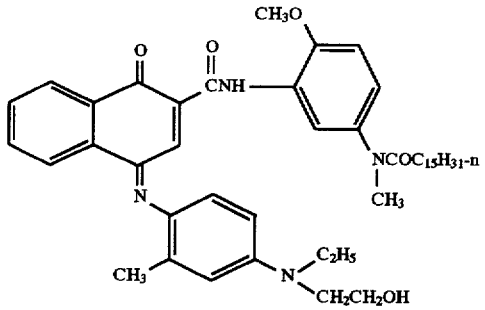

In addition to the cyan dummy dye, a layer of the negative element also contains a ballasted stabilizer compound therefor. Such compound has the formula:

$$B—L—A—R \quad (II)$$

wherein:

B is a ballast group;

L is a divalent linking group;

A is a group of the formula:

$$-\overset{O}{\overset{\|}{C}}-\underset{\underset{R'}{|}}{CH}-\overset{O}{\overset{\|}{C}}- \quad (III)$$

wherein

R' is hydrogen or an alkyl or alkoxy group; and

R is hydrogen or an aliphatic or aromatic group linked directly or through a nitrogen or oxygen atom to A.

The group B serves the purpose of ballasting the stabilizer within the element so that it will remain in the vicinity of the dummy dye that it serves to stabilize. Ballast materials are well-known in the art as described in the Research Disclosure publications hereafter. Typically, they comprise the same types of hydrophobic materials described for use with the dyes of the invention. Conveniently, they may be polymeric in nature enabling them to incorporate more than one stabilizing group per molecule.

Generally, B is a group containing at least 6 carbon atoms. Suitably B is a polymer having backbone molecular weight of greater than 1000 which may comprise a polyvinyl, polyester, polyether, polyurethane, polyamide, polyacrylate, or polymethacrylate polymer or copolymers thereof. It is especially suitable when the polymeric chain is a polyalkylene group, especially one obtained by polymerizing an acrylate or methacrylate monomer.

In formula (III), L is a divalent linking group. There are no particular limitations as to the identity of the linking group so long as it does not interfere through reactivity or otherwise with the intended photographic function of the element. Thus the group may be methylene, or a chain containing one or more alkylene or arylene groups possibly interrupted by heteroatoms such as oxygen or nitrogen.

Desirably, L contains and is linked to B by a group such as —C(O)O—, —C(O)NR'—, —$CH_2$—, —O—, —NR'—, —OR'—, —OR'O—, —C(O)OR'O—, —C(O)R'O—, or —C(O)N(R')R"O— wherein each R' is independently hydrogen or an alkyl group and each R" is an independently selected alkyl group. Suitable examples are —C(O)$OCH_2CH_2O$—, —C(O)$OCH_2CH_2CH_2O$—, —C(O)$NHCH_2CH_2CH_2NH$—, —C(O)$OCH_2CH_2NH$—, —C(O)$OCH_2C(CH_3)_2$—, —C(O)$OCH_2C(CH_3)_2CH_2O$—, —C(O)$NHCH_2CH_2O$—, and —C(O)$OCH_2CH(CH_3)O$—.

A is a group of the formula:

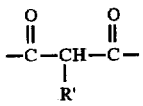

(III)

wherein

R' is hydrogen or an alkyl or alkoxy group. Most typically, R' is hydrogen or lower alkyl such as methyl.

R is hydrogen or an aliphatic or aromatic group linked directly or through a nitrogen or oxygen atom to A. R is typically an alkyl, aryl, alkoxy, aryloxy, alkylamido, or arylamido group. An alkyl group, particularly an unsubstituted alkyl group such as methyl or ethyl are satisfactory and readily manufactured.

In the case of a polymeric B group, synthesis methods are well-known. For example, in latex polymerization, the selected monomers are colloidally emulsified in an aqueous medium that usually contains a cationic, nonionic, or zwiterionic surfactant and a polymerization catalyst such as 2,2'-azobis(2-amidinopropane)hydrochloride. The resulting colloidal emulsion is then subjected to conditions conducive to polymerization of the monomeric species to produce an aqueous colloidal dispersion commonly called a latex. General methods for preparation may be found in *Principles of Polymerization 2d Ed*, G. Odian, J. Wiley, N.Y., NY (1981).

The following are examples of compounds which may suitably be used as stabilizers of the invention:

I-1

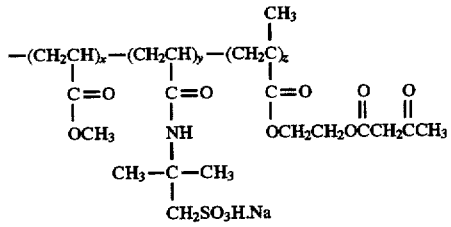

x:y:z= 91:5:4 wt. ratio

I-2

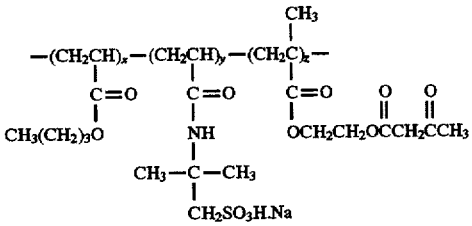

x:y:z= 90:6:4 wt. ratio

I-3

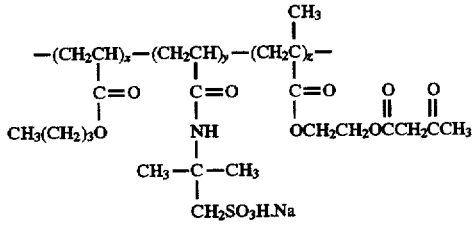

x:y:z= 88:4:8 wt. ratio

-continued

I-4

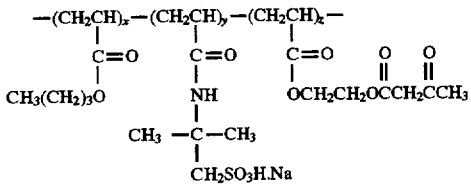

x:y:z= 90:6:4 wt. ratio

I-5

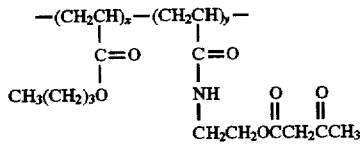

x:y= 80:20 wt. ratio

I-6

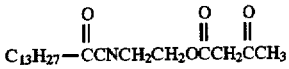

I-7

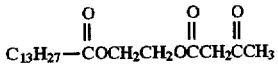

I-8

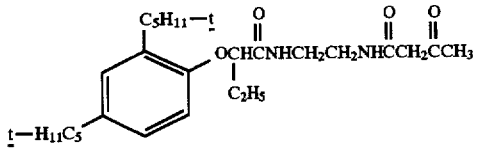

I-9

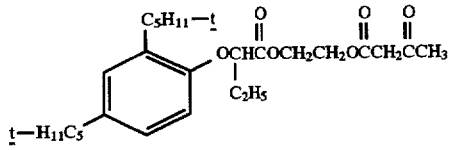

I-10

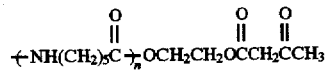

n>10

I-11

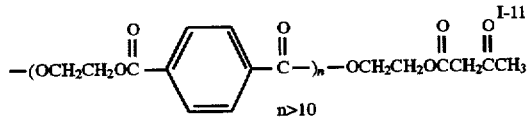

n>10

I-12

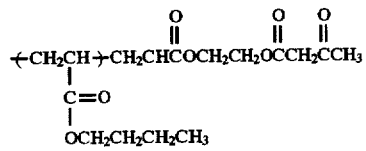

n>10

Suitable repeating units useful when B is a polymer are (at >1 wt % in polymer):

U-1

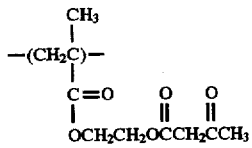

-continued

U-2

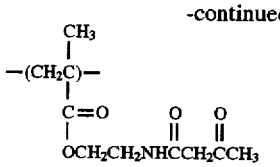

U-3

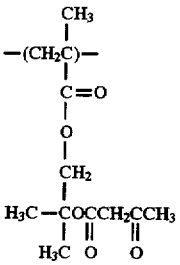

U-4

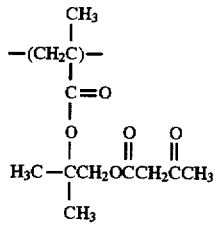

U-5

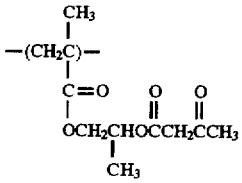

U-6

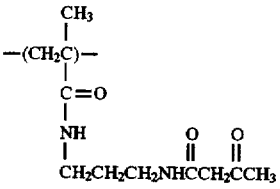

U-7

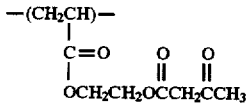

U-8

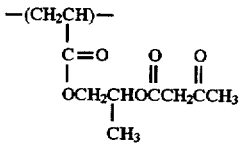

U-9

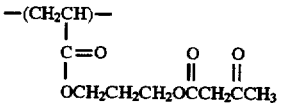

U-10

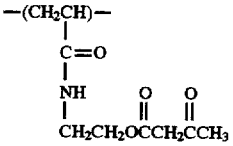

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha-or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy)

ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

To control the migration of various components, it may be desirable to include a high molecular weight hydrophobe or "ballast" group in coupler molecules and in the stabilizer of the invention. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94–6023, published Mar. 15, 1994, avaliable from the Japanese Patent Office, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1994, Item 36544, available as described above, which will be identified hereafter by the term "Research Disclosure" The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX. Certain desirable photographic elements and processing steps, particularly those useful in conjunction with color reflective prints, are described in *Research Disclosure*, Item 37038, February. 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of a coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine Literature Ubersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654, and "Farbkuppler-eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine Literature Ubersicht," published in Agfa Mitteilungen, Band III, pp.

112–126 (1961). Such couplers are typically open chain ketomethylene compounds.

Couplers that form colorless products upon reaction with oxidized color developing agent are described in such representative patents as: UK. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2-or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213,490; Japanese Published Application 58–172,647; U.S. Pat. Nos. 2,983,608; 4,070,191; and 4,273,861; German Applications DE 2,706,117 and DE 2,643,965; UK. Patent 1,530,272; and Japanese Application 58–113935. The masking couplers may be shifted or blocked, if desired.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

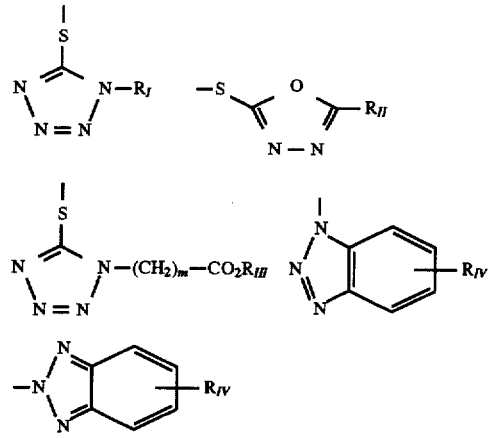

wherein $R_I$ is selected from the group consisting of straight and branched alkyls of from 1 to about 8 carbon atoms, benzyl, phenyl, and alkoxy groups and such groups containing none, one or more than one such substituent;

$R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group, which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. No. 4,409,323; 4,421,845; Japanese Applications 57-188035; 58-98728; 58-209736; 58-209738) groups utilizing ester hydrolysis (German Patent Application (OLS) No. 2,626,315); groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above. It is typical that the timing group or moiety is of one of the formulas:

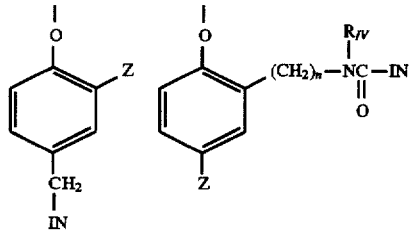

wherein

IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{V7}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

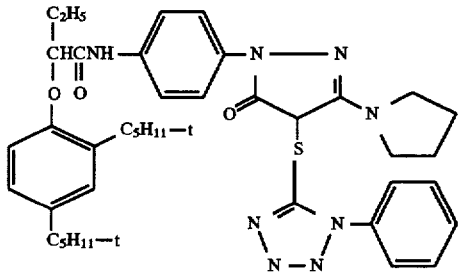

-continued

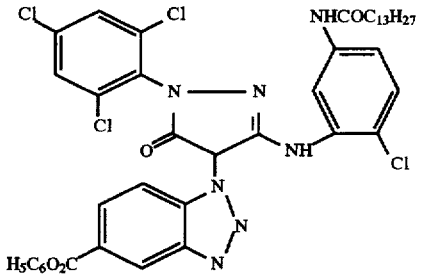

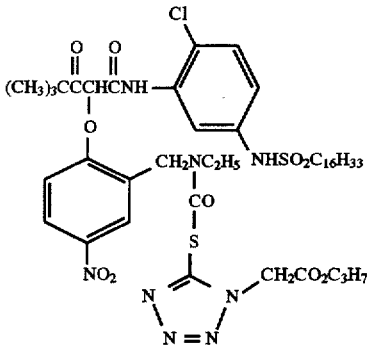

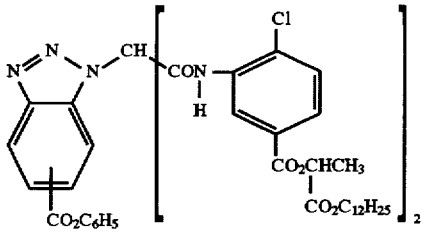

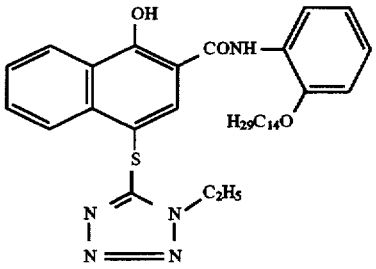

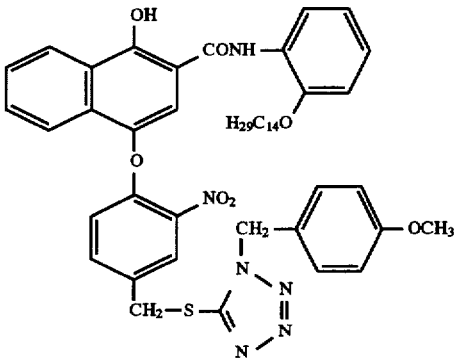

-continued

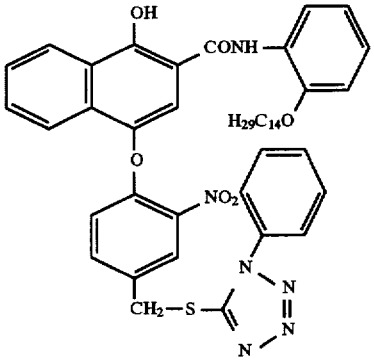

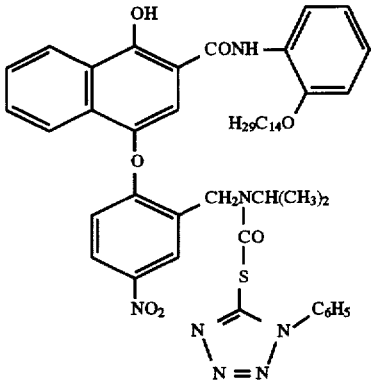

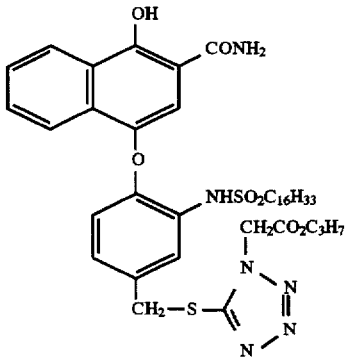

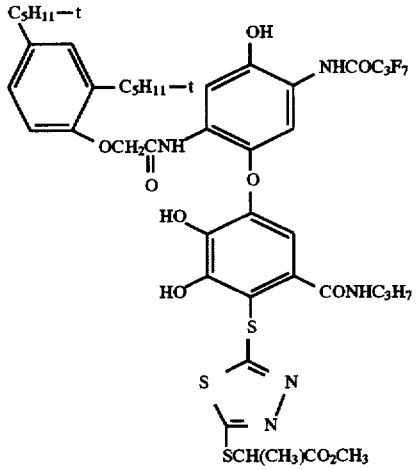

-continued

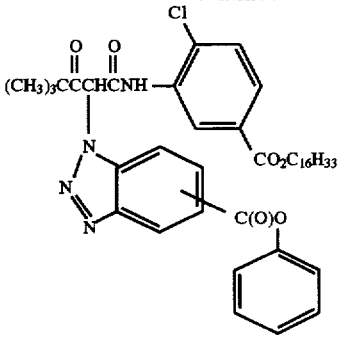

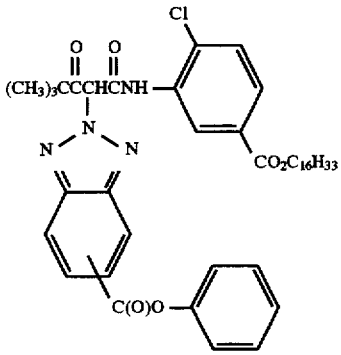

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.06 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamido-ethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

EXAMPLE 1

To a glow-discharge-treated polyethylene-2,6-naphthalene support, which was coated with a continuous subbing layer consisting of a terpolymer of n-butyl acryate, 2-aminoethyl methacrylate hydrochloride, and 2-hydroxyethyl methacrylate (50:05:45 wt ratio), gelatin, and surfactant; the following layers were applied in the indicated sequence to produce Coating 4-1. The quantities quoted each relate to g/m$^2$. Emulsion sizes as determined by the disc centrifuge method are reported in Diameter× Thickness in microns. The emulsions in the cyan layers are sensitized with dye set 1. The emulsions in the magenta layers are sensitized with dye set 2. The emulsions in the yellow layers are sensitized with sensitizing dye YD-A.

| | | |
|---|---|---|
| Layer 1 | Antiilialation Undercoat | |
| | Black colloidal silver | 0.15 |
| | Gelatin | 1.61 |
| | Hexasodium salt of metaphosphoric acid | 0.011 |
| | Disodium salt of 3,5,-disulfocatecol | 0.270 |
| | 4-4-phenyl disulfide diacetanilide | 0.0012 |
| | Dye 1 | 0.014 |
| | Dye 2 (D-2) | 0.022 |
| | Oxidized developer scavenger O-2 | 0.14 |
| | Dye 5 | 0.016 |
| | 4-carboxymethyl-4-thiazolone-2-thione | 0.0009 |
| Layer 3 | Slow cyan layer | |
| | Tabular emulsion, 1.1 × .09, 4.1 mole % I | 0.27 |
| | Tabular emulsion, 0.5 × .08, 1.3 mole % I | 0.47 |
| | Gelatin | 2.01 |
| | Cyan dye forming coupler C-1 | 0.48 |
| | Bleach accelerator releasing coupler B-2 | 0.082 |
| | Masking Coupler MC-1 | 0.028 |
| Layer 4 | Mid cyan layer | |
| | Tabular emulsion, 1.3 × .12, 4.1 mole % I | 0.79 |
| | Gelatin | 1.18 |
| | Cyan dye forming coupler C-1 | 0.16 |
| | Development inhibitor releasing coupler DIR-1 | 0.011 |
| | Masking Coupler MC-1 | 0.022 |
| Layer 5 | Fast cyan layer | |
| | Tabular emulsion, 2.5 × .12, 4.1 mole % I | 1.076 |
| | Gelatin | 1.24 |
| | Cyan dye forming coupler C-1 | 0.12 |
| | Development inhibitor releasing coupler DIR-1 | 0.019 |
| | Development inhibitor releasing coupler DIR-2 | 0.048 |
| | Masking Coupler MC-1 | 0.032 |
| Layer 6 | Interlayer | |
| | Gelatin | 0.70 |
| | Oxidized developer scavenger O-2 | 0.075 |
| Layer 7 | Yellow magenta layer | |
| | Tabular emulsion, 1.0 × .09, 4.1 mole % I | 0.24 |
| | Tabular emulsion, 0.5 × .08, 1.3 mole % I | 0.51 |
| | Gelatin | 1.18 |
| | Magenta dye forming coupler M-1 | 0.30 |
| | Masking Coupler MC-2 | 0.042 |

-continued

| | | |
|---|---|---|
| Layer 8 | Mid magenta layer | |
| | Tabular emulsion, 1.3 × .12, 4.1 mole % I | 0.97 |
| | Gelatin | 1.32 |
| | Development inhibitor releasing coupler DIR-3 | 0.024 |
| | Magenta dye forming coupler M-1 | 0.057 |
| | Masking Coupler MC-2 | 0.032 |
| Layer 9 | Fast magenta layer | |
| | Tabular emulsion, 2.3 × .12, 4.1 mole % I | 0.97 |
| | Gelatin | 1.55 |
| | Development inhibitor releasing coupler DIR-4 | 0.011 |
| | Development inhibitor releasing coupler DIR-5 | 0.011 |
| | Magenta dye forming coupler M-1 | 0.088 |
| | Masking Coupler MC-2 | 0.043 |
| Layer 10 | Yellow filter layer | |
| | Yellow filter dye AD-1 | 0.16 |
| | Gelatin | 0.65 |
| | Oxidized developer scavenger O-2 | 0.075 |
| Layer 11 | Slow yellow layer | |
| | Tabular emulsion, 1.7 × .13, 4.1 mole % I | 0.23 |
| | Tabular emulsion, 1.1 × .13, 1.5 mole % I | 0.089 |
| | Tabular emulsion, 0.5 × .08, 1.3 mole % I | 0.19 |
| | Gelatin | 1.72 |
| | Yellow dye forming coupler Y-3 | 0.69 |
| | Development inhibitor releasing coupler DIR-7 | 0.022 |
| | Bleach accelerator releasing coupler B-2 | 0.002 |
| Layer 12 | Fast yellow layer | |
| | Tabular emulsion, 3.3 × .14, 4.1 mole % I | 0.48 |
| | Gelatin | 1.38 |
| | Yellow dye forming coupler Y-3 | 0.53 |
| | Development inhibitor releasing coupler DIR-7 | 0.034 |
| | Bleach accelerator releasing coupler B-2 | 0.006 |
| | Cyan dye forming coupler C-1 | 0.022 |
| Layer 13 | UV filter layer | |
| | Silver bromide Lippmann emulsion | 0.215 |
| | UV-1 | 0.108 |
| | UV-2 | 0.108 |
| | Gelatin | 0.699 |
| Layer 14 | Protective overcoat layer | |
| | Matte Beads | |
| | Gelatin | 0.882 |

Hardener(bis(vinylsulfonyl)methane at 1.55% of total gelatin weight). Unless otherwise noted, antifoggants (including 4-hydroxy-6-methyl-1,3,3a,7-tetraazaindene), surfactants, coating aids, emulsion addenda, sequestrants, lubricants, matte, coupler solvents, and tinting dyes were added to the appropriate layers as is common in the art. Magnetic recording layers were coated on the backside of the support.

Coating 1-2 was prepared like coating 1-1 except that to layer 1 was added 0.65 g/m$^2$ of 1,3-butanediol.

Coating 1-3 was prepared like coating 1-2 except that in layer 1 Dye 2 (D-2) was omitted.

Coating 1-4 was prepared like coating 1-2 except that to layer 1 was added 0.65 g/m$^2$ of I-1.

Coating 1-5 was prepared like coating 1-2 except that to layer 1 was added 0.65 g/m$^2$ of CSt-1.

Coating 1-6 was prepared like coating 1-2 except that to layer 1 was added 0.65 g/m$^2$ of CSt-2.

Coating 1-7 was prepared like coating 1-2 except that to layer 1 was added 0.65 g/m$^2$ of I-2.

Coating 1-8 was prepared like coating 1-1 except that to layer 1 was added 0.65 g/m$^2$ of I-2.

Coating 1-9 was prepared like coating 1-3 except that to layer 1 was added 0.65 g/m$^2$ of I-2.

Coating 1-10 was prepared like coating 1-2.

Coating 1-11 was prepared like coating 1-2 except that the support was cellulose triacetate, and the hardener was coated at 1.80% of total gelatin weight. The magnetic layers were omitted from the backside of the support.

Coating 1-12 was prepared like coating 1-13 except that to layer 1 was added 0.65 g/m$^2$ of I-2.

The results are shown in Table I.

TABLE I

| Coating # | Type | Delta Red Dmin 4 wk/49° C. minus 4 wk/−18° C. | Delta Red Dmin 12 wk/26° C. minus 12 wk/−18° C. | Delta Red Dmin 12 wk/26° C. minus fresh |
|---|---|---|---|---|
| 1-1 | Comparative | +.057 | −.005 | +.005 |
| 1-2 | Comparative | +.086 | +.007 | +.008 |
| 1-3 | Comparative | +.050 | +.001 | .00 |
| 1-4 | Invention | +.073 | −.014 | .00 |
| 1-5 | Comparative | +.086 | +.003 | .00 |
| 1-6 | Comparative | +.081 | −.003 | +.003 |
| 1-7 | Invention | +.043 | −.015 | .00 |
| 1-8 | Invention | +.027 | −.011 | −.009 |
| 1-9 | Comparative | +.053 | +.007 | +.013 |
| 1-10 | Comparative | +.093 | +.006 | +.007 |
| 1-11 | Comparative | +.052 | +.012 | +.023 |
| 1-12 | Invention | +.007 | −.011 | +.007 |

Red Dmin = Cyan Density im area of minimum red light exposure.
4 wk/49° C. = Stored 4 weeks at 49° C. at 50% relative humidity.
4 wk/−18° C. = Stored 4 weeks at −18° C. at 50% relative humidity.
12 wk/26° C. = Stored 12 weeks at 26° C. at 50% relative humidity.
12 wk/−18° C. = Stored 12 weeks at −18° C. at 50% reiative humidity.
fresh = Stored less than one week at room temperature and humidity.

The comparisons against a zero degree check are indications of a films sensitivity to storage under room or other elevated temperatures.

The comparisons against a fresh check are indications of a film's stability during storage at the indicated temperature and its sensitivity to ambient radiation.

Coating 1-1 features the use of Dye-2 (D-2) in layer 1, and demonstrates high red Dmin growth with 49° C. conditioning. Coating 1-2 is like coating 1-1 except for the addition of a humectant for accelerated hardening and for improved uniformity of hardness throughout a production coating roll. Coating 1-2 demonstrates even higher red Dmin growth than coating 1-1 with 49° C. conditioning. Coating 1-3 is like coating 1-2 except that Dye-2 was omitted. Comparing 1-3 to 1-2, one finds that Dye-2 exacerbates red Dmin growth with 49° C. conditioning, which illustrates the problem to be solved by this invention. Coating 1-4 was prepared like coating 1-2 except that to layer 1 was added 0.65 g/m$^2$ of inventive stabilizer I-1, which provides lower red Dmin growth with 49° C. or 26° C. conditioning. The level of I-1 provided enough Dmin reduction to compensate for increased Dmin due to ambient radiation, as indicated by the 'Delta Red Dmin 12 wk/26° C. minus fresh' data. Coating 1-5 was prepared like coating 1-2 except that to layer 1 was added 0.65 g/m$^2$ of comparative stabilizer CSt-1, which did not provide any significant reduction in red Dmin. Coating 1-6 was prepared like coating 1-2 except that to layer 1 was added 0.65 g/m$^2$ of comparative stabilizer CSt-2, which did not provide any significant reduction in red Dmin. Coating 1-7 was prepared like coating 1-2 except that to layer 1 was added 0.65 g/m$^2$ of inventive stabilizer I-2, which provided lower red Dmin growth with 49° C. or 26° C. conditioning. The level of I-2 provided more than enough Dmin reduction to compensate for increased Dmin due to ambient radiation, as indicated by the 'Delta Red Dmin 12 wk/26° C. minus fresh' data. It is expected that the level of the stabilizer could be adjusted to provide zero Ddmin movement. Coating 1-8 was prepared like coating 1-1 except that to layer 1 was added 0.65 g/m$^2$ of I-2, which provides lower red Dmin growth with 49° C. or 26° C. conditioning. This result is in the absence of any added humectant. The level of I-2 provided more than enough Dmin reduction to compensate for increased Dmin due to ambient radiation, as indicated by the 'Delta Red Dmin 12 wk/26° C. minus fresh' data. It is expected that the level of the stabilizer could be adjusted to provide zero Dmin movement. Coating 1-9 was prepared like coating 1-3 (no Dye-2) except that to layer 1 was added 0.65 g/m$^2$ of I-2, which did not provide any significant reduction in red Dmin. Therefore both the use of Dye-2 and the use of the inventive stabilizers is necessary to achieve the inventive results. Coating 1-10 was prepared like coating 1-2 and serves to provide a measure of the repeatability in the reported data. Plus or minus 10% is an approximation. Coating 1-12 compared to coating 1-11 demonstrates the the inventive combination works on cellulose acetate support as well as on polyethylene naphthalate support and whether or not there is present a magnetic layer.

Comparative cyan dyes were as follows:

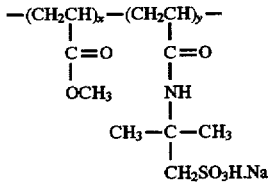

CSt−1 x:y = 96:4 wt ratio

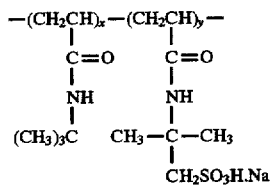

CSt-2 x:y = 94:6 wt ratio

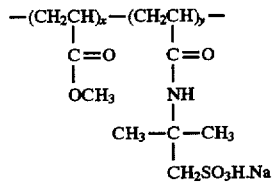

CSt-3 x:y = 95:5 wt ratio

EXAMPLE 2

To a corona-discharge-treated polyethylene-2,6-naphthalene support, which was coated with a continuous subbing layer consisting of a terpolymer of n-butyl acryate, 2-aminoethyl methacrylate hydrochloride, and 2-hydroxyethyl methacrylate (50:05:45 wt ratio) at 0.317 g/m$^2$; deionized gelatin at 0.056 g/m$^2$; matte beads at 0.001 g/m$^2$; and surfactant 10 G" (Dixie) at 0.012 g/m$^2$; the following layers were applied in the indicated sequence to produce Coating 2-1. The quantities quoted each relate to g/m$^2$. Emulsion sizes as determined by the disc centrifuge method are reported in Diameter x Thickness in microns. The emulsions in the cyan layers are sensitized with dye set 1. The emulsions in the magenta layers are sensitized with dye set 2. The emulsions in the yellow layers are sensitized with sensitizing dye YD-A.

| | | |
|---|---|---|
| Layer 1 | AntiHalation Undercoat | |
| | Black colloidal silver | 0.151 |
| | Gelatin | 1.61 |
| | Hexasodium salt of metaphosphoric acid | 0.007 |
| | Disodium salt of 3,5,-disulfocatecol | 0.18 |
| | Dye 1 | 0.079 |
| | Dye 2 (D-2) | 0.019 |
| | Oxidized developer scavenger O-2** | 0.108 |
| | Dye-6 | 0.077 |
| | Dye 3 | 0.022 |
| | UV-1 | 0.032 |
| | UV-2 | 0.075 |
| Layer 2 | Slow cyan layer | |
| | Tabular emulsion, 0.8 × .12, 4.1 mole % I | 0.33 |
| | Tabular emulsion, 0.5 × .08, 1.3 mole % I | 0.29 |
| | Gelatin | 1.36 |
| | Cyan dye forming coupler C-1 | 0.43 |
| | Bleach accelerator releasing coupler B-1 | 0.054 |
| Layer 3 | Mid cyan layer | |
| | Tabular emulsion, 1.1 × .12, 4.1 mole % I | 0.97 |
| | Gelatin | 1.35 |
| | Cyan dye forming coupler C-1 | 0.34 |
| | Development inhibitor releasing coupler DIR-1 | 0.043 |
| | Bleach accelerator releasing coupler B-1 | 0.032 |
| | Masking Coupler MC-1 | 0.011 |
| Layer 4 | Fast cyan layer | |
| | Tabular emulsion, 1.4 × .12, 4.1 mole % I | 0.86 |
| | Gelatin | 0.97 |
| | Cyan dye forming coupler C-1 | 0.12 |
| | Development inhibitor releasing coupler DIR-1 | 0.043 |
| | Masking Coupler MC-1 | 0.016 |
| | Yellow dye forming coupler Y-1 | 0.065 |
| Layer 5 | Interlayer | |
| | Gelatin | 0.43 |
| | Oxidized developer scavenger O-2 | 0.075 |
| Layer 6 | Slow magenta layer | |
| | Tabular emulsion, 0.8 × .11, 2.6 mole % I | 0.38 |
| | Gelatin | 1.18 |
| | Magenta dye forming coupler M-1 | 0.27 |
| | Masking Coupler MC-2 | 0.043 |
| Layer 7 | Mid magenta layer | |
| | Tabular emulsion, 1.1 × .12, 4.1 mole % I | 0.70 |
| | Gelatin | 1.16 |
| | Development inhibitor releasing coupler DIR-3 | 0.016 |
| | Magenta dye forming coupler M-1 | 0.12 |
| | Masking Coupler MC-2 | 0.054 |
| Layer 8 | Fast magenta layer | |
| | Tabular emulsion, 1.4 × .12, 4.1 mole % I | 0.75 |
| | Gelatin | 1.04 |
| | Development inhibitor releasing coupler DIR-4 | 0.011 |
| | Magenta dye forming coupler M-1 | 0.053 |
| | Masking Coupler MC-2 | 0.043 |
| Layer 9 | Yellow filter layer | |
| | Yellow filter dye AD-1 | 0.13 |
| | Gelatin | 0.65 |
| | Oxidized developer scavenger O-2 | 0.075 |
| Layer 10 | Slow yellow layer | |
| | Tabular emulsion, 1.4 × .13, 4.1 mole % I | 0.25 |
| | Tabular emulsion, 1.1 × .13, 1.5 mole % I | 0.10 |
| | Tabular emulsion, 0.5 × .08, 1.3 mole % I | 0.15 |
| | Gelatin | 2.77 |
| | Yellow dye forming coupler Y-1 | 0.70 |
| | Yellow dye forming coupler Y-2 | 0.59 |
| | Development inhibitor releasing coupler DIR-6 | 0.12 |
| | Development inhibitor releasing coupler DIR-3 | 0.022 |
| | 1,3 Butanediol | 0.065 |
| | Bleach accelerator releasing coupler B-1 | 0.005 |
| Layer 11 | Fast yellow layer | |
| | Tabular emulsion, 2.9 × .13, 4.1 mole % I | 0.56 |
| | Gelatin | 1.50 |
| | Yellow dye forming coupler Y-1 | 0.18 |
| | Yellow dye forming coupler Y-2 | 0.15 |
| | Development inhibitor releasing coupler DIR-6 | 0.057 |
| | Development inhibitor releasing coupler DIR-3 | 0.006 |
| | Bleach accelerator releasing coupler B-1 | 0.005 |
| Layer 12 | UV filter layer | |
| | Silver bromide Lippmann emulsion | 0.215 |
| | UV-1 | 0.108 |
| | UV-2 | 0.108 |
| | Gelatin | 0.699 |

-continued

| | | |
|---|---|---|
| Layer 13 | Protective overcoat layer | |
| | Colloidal silica | 0.108 |
| | Gelatin | 0.882 |

Hardener(bis(vinylsulfonyl)methane at 1.50% of total gelatin weight). Unless otherwise noted, antifoggants (including 4-hydroxy-6-methyl-1,3,3a,7-tetraazaindene), surfactants, coating aids, emulsion addenda, sequestrants, lubricants, matte, tinting dyes, coupler solvents, and soluble absorber dyes were added to the appropriate layers as is common in the art. Magnetic recording layers were coated on the backside of the support.

Coating 2-2 was prepared like coating 2-1 except that to layer 1 was added 0.67 g/m$^2$ of I-2.

Coating 2-3 was prepared like coating 2-1 except that to layer 1 was added 0.67 g/m$^2$ of CSt-3.

The results are shown in Tables II and III.

TABLE II

| Coating # | Type | Delta Red Dmin 8 wk/38° C. minus 8 wk/−18° C. | Delta Red Dmin 12 wk/26° C. minus 12 wk/−18° C. | Delta Red Dmin 12 wk/26° C. minus fresh |
|---|---|---|---|---|
| 2-1 | Comparative | +.055 | +.02 | +.032 |
| 2-2 | Invention | +.007 | −.002 | +.003 |
| 2-3 | Comparative | +.046 | +.016 | +.02 |

TABLE III

| Coating # | Type | Delta Red Dmin 24 wk/26° C. minus 24 wk/0–18° C. | Delta Red Dmin 24 wk/26° C. minus fresh | Delta Red Dmin 52 wk/26° C. minus 52 wk/−18° C. | Delta Red Dmin 52 wk/26° C. minus fresh |
|---|---|---|---|---|---|
| 2-1 | Comp | +.032 | +.042 | +.065 | +.104 |
| 2-2 | Inv | −.003 | +.002 | +.016 | +.057 |
| 2-3 | Comp | +.028 | +.034 | +.058 | +.095 |

8 wk/38° C. = Stored 8 weeks at 38° C. at 50% relative humidity
8 wk/−18° C. = Stored 8 weeks at −18° C. at 50% relative humidity
24 w/26° C. = Stored 24 weeks at 26° C. at 50% relative humidity
24 w/−18° C. = Stored 24 weeks at −18° C. at 50% relative humidity
52 w/26° C. = Stored 52 weeks at 26° C. at 50% relative humidity
52 w/−18° C. = Stored 52 weeks at −18° C. at 50% relative humidity The comparisons against a zero degree check are indications of a film's instability during storage under room or elevated temperature conditions.

The comparisons against a fresh check are indications of a films instability during storage under room or elevated temperatures and its sensitivity to ambient radiation.

Coating 2-1 features the use of Dye-2 in layer 1, and demonstrates high red Dmin growth with 49° C. conditioning. Coating 2-2 was prepared like coating 2-1 except that to layer 1 was added 0.65 g/m$^2$of I-2, which provides lower red dmin growth with 38° C. or 26° C. conditioning. The level of I-1 provided enough dmin reduction to compensate for increased Dmin due to ambient radiation, as indicated by the 'Delta RedDmin 12 wk/26° C. minus fresh' and the 'Delta RedDmin 24 wk/26° C. minus fresh' data. The 'Delta RedDmin 52 wk/26° C. minus fresh' data shows substantially lower red Dmin with the inventive combination on coating 2-2. Coating 2-3 was prepared like coating 2-1 except that to layer 1 was added 0.65 g/m$^2$ of CSt-3, which did not provide any significant reduction in red Dmin.

EXAMPLE 3

To a corona-discharge-treated polyethylene-2,6-naphthalene support, which was coated with a continuous subbing layer consisting of a terpolymer of n-butyl acryate, 2-aminoethyl methacrylate hydrochloride, and 2-hydroxyethyl methacrylate (50:05:45) at 0.317 g/m$^2$; deionized gelatin at 0.056 g/m$^2$; matte beads at 0.001 g/m$^2$; and surfactant 10G" (Dixie) at 0.012 g/m$^2$; the following layers were applied in the indicated sequence to produce Coating 3-1. The quantities quoted each relate to g/m$^2$. Emulsion sizes as determined by the disc centrifuge method are reported in Diameter x Thickness in microns. The emulsions in the cyan layers are sensitized with dye set 1. The emulsions in the magenta layers are sensitized with dye set 2. The emulsions in the yellow layers are sensitized with sensitizing dye YD-A.

| | | |
|---|---|---|
| Layer 1 | AntiHalation Undercoat | |
| | Black colloidal silver | 0.151 |
| | Gelatin | 1.61 |
| | Hexasodium salt of metaphosphoric acid | 0.007 |
| | Disodium salt of 3,5,-disulfocatecol | 0.18 |
| | Dye 1 | 0.079 |

-continued

| | | |
|---|---|---|
| | Dye 2 | 0.019 |
| | Oxidized developer scavenger O-2 | 0.108 |
| | Dye-6 | 0.060 |
| | Dye 3 | 0.022 |
| | UV-1 | 0.032 |
| | UV-2 | 0.075 |
| Layer 2 | Slow cyan layer | |
| | Tabular emulsion, 0.8 × .12, 4.1 mole % 1 | 0.32 |
| | Tabular emulsion, 0.5 × .08, 1.3 mole % I | 0.28 |
| | Gelatin | 1.34 |
| | Cyan dye forming coupler C-1 | 0.43 |
| | Bleach accelerator releasing coupler B- | 0.054 |
| Layer 3 | Mid cyan layer | |
| | Tabular emulsion, 1.1 × .12, 4.1 mole % I | 0.97 |
| | Gelatin | 1.35 |
| | Cyan dye forming coupler C-1 | 0.34 |
| | Development inhibitor releasing coupler DIR-1 | 0.043 |

-continued

| | | |
|---|---|---|
| | Bleach accelerator releasing coupler B-1 | 0.032 |
| | Masking Coupler MC-1 | 0.011 |
| Layer 4 | Fast cyan layer | |
| | Tabular emulsion, 1.4 × .12, 4.1 mole % I | 0.86 |
| | Gelatin | 0.97 |
| | Cyan dye forming coupler C-1 | 0.12 |
| | Development inhibitor releasing coupler DIR-1 | 0.043 |
| | Masking Coupkr MC-1 | 0.016 |
| | Yellow dye forming coupler Y-1 | 0.065 |
| Layer 5 | Interlayer | |
| | Gelatin | 0.43 |
| | Oxidized developer scavenger O-2 | 0.075 |
| Layer 6 | Slow magenta layer | |
| | Tabular emulsion, 0.8 × .11, 2.6 mole % I | 0.38 |
| | Gelatin | 1.18 |
| | Magenta dye forming coupler M-1 | 0.27 |
| | Masking Coupler MC-2 | 0.043 |
| Layer 7 | Mid magenta layer | |
| | Tabular emulsion, 1.1 × .12, 4.1 mole % I | 0.70 |
| | Gelatin | 1.16 |
| | Development inhibitor releasing coupler DIR-3 | 0.016 |
| | Magenta dye forming coupler M-1 | 0.12 |
| | Masking Coupler MC-2 | 0.054 |
| Layer 8 | Fast magenta layer | |
| | Tabular emulsion, 1.4 × .12, 4.1 mole % I | 0.75 |
| | Gelatin | 1.04 |
| | Development inhibitor releasing coupler DIR-4 | 0.011 |
| | Magenta dye forming coupler M-1 | 0.053 |
| | Masking Coupler MC-2 | 0.043 |
| Layer 9 | Yellow filter layer | |
| | Yellow filter dye AD-1 | 0.13 |
| | Gelatin | 0.65 |
| | Oxidized developer scavenger O-2 | 0.075 |
| Layer 10 | Slow yellow layer | |
| | Tabular emuision, 1.4 × .13, 4.1 mole % I | 0.25 |
| | Tabular emulsion, 1.1 × .13, 1.5 mole % I | 0.11 |
| | Tabular emulsion, 0.5 × .08, 1.3 mole % I | 0.16 |
| | Gelatin | 2.77 |
| | Yellow dye forming coupler Y-1 | 0.70 |

-continued

| | | |
|---|---|---|
| | Yellow dye forming coupler Y-2 | 0.48 |
| | Development inhibitor releasing coupler DIR-6 | 0.12 |
| | Development inhibitor releasing coupler DIR-3 | 0.022 |
| | 1,3 Butanediol | 0.065 |
| | Bleach accelerator releasing coupler B-1 | 0.005 |
| Layer 11 | Fast yellow layer | |
| | Tabular emulsion, 2.9 × .13, 4.1 mole % I | 0.56 |
| | Gelatin | 1.50 |
| | Yellow dye forming coupler Y-1 | 0.1 8 |
| | Yellow dye forming coupler Y-2 | 0.21 |
| | Development inhibitor releasing coupler DIR-6 | 0.057 |
| | Development inhibitor releasing coupler DIR-3 | 0.006 |
| | Bleach accelerator releasing coupler B-1 | 0.005 |
| Layer 12 | UV filter layer | |
| | Silver broniide Lippmann emulsion | 0.215 |
| | UV-1 | 0.108 |
| | UV-2 | 0.108 |
| | Gelatin | 0.699 |
| Layer 13 | Protective overcoat layer | |
| | Colloidal silica | 0.108 |
| | Gelatin | 0.882 |

Hardener(bis(vinylsulfonyl)methane at 1.50% of total gelatin weight). Unless otherwise noted, antifoggants (including 4-hydroxy-6-methyl-1,3,3a,7-tetraazaindene), surfactants, coating aids, emulsion addenda, sequestrants, lubricants, matte, tinting dyes, coupler solvents, and soluble absorber dyes were added to the appropriate layers as is common in the art. Magnetic recording layers were coated on the backside of the support.

Coating 3-2 was prepared like coating 3-1 except that to layer 1 was added 0.32 g/m$^2$ of I-2.

Coating 3-3 was prepared like coating 3-1 except that to layer 1 was added 0.65 g/m2 of I-2.

The results are shown in Tables IV and V.

TABLE IV

| Coating # | Type | Delta Red Dmin 4 wk/49° C. minus 4 wk/−18° C. | Delta Red Dmin 8 wk/38° C. minus 8 wk/−18° C. | Delta Red Dmin 12 wk/26° C. minus 12 wk/−18° C. | Delta Red Dmin 12 wk/26° C. minus fresh |
|---|---|---|---|---|---|
| 3-1 | Comp | +.36 | +.072 | +.019 | +.022 |
| 3-2 | Inv | +.22 | +.049 | +.006 | +.011 |
| 3-3 | Inv | +.13 | +.016 | −.004 | .00 |

TABLE V

| Coating # | Type | Delta Red Dmin 24 wk/26° C. minus 24 wk/−18° C. | Delta Red Dmin 24 wk/26° C. minus fresh | Delta Red Dmin 52 wk/26° C. minus 52 wk/−18° C. | Delta Red Dmin 52 wk/26° C. minus fresh |
|---|---|---|---|---|---|
| 3-1 | Comp | +.043 | +.039 | +.064 | +.083 |
| 3-2 | Inv | +.019 | +.019 | +.041 | +.061 |
| 3-3 | Inv | +.010 | +.004 | +.018 | +.037 |

Coating 3-1 features the use of Dye-2 in layer 1, and demonstrates high red Dmin growth with 49° C. conditioning. Coating 3-2 was prepared like coating 3-1 except that to layer 1 was added 0.32 g/m$^2$ of I-2, which provides lower red Dmin growth with 49° C., 38° C. or 26° C. conditioning. The level of I-2 can be adjusted as in coating 3-3 to provide enough Dmin reduction to compensate for increased Dmin due to ambient radiation, as indicated by the 'Delta Red Dmin 12 wk/26° C. minus fresh' and the 'Delta RedDmin 24 wk/26° C. minus fresh' data. The 'Delta RedDmin 52 wk/26° C. minus fresh' data shows substantially lower red Dmin with the inventive combinations in coatings 3-2 and 3-3, as compared to coating 3-1.

Formulas for compounds used in the multilayers were as follows:

AD-1:

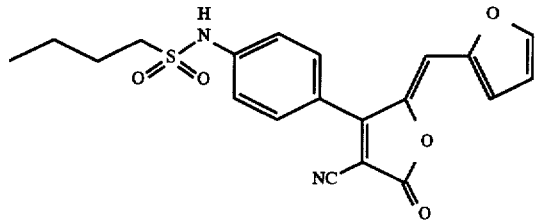

B-1

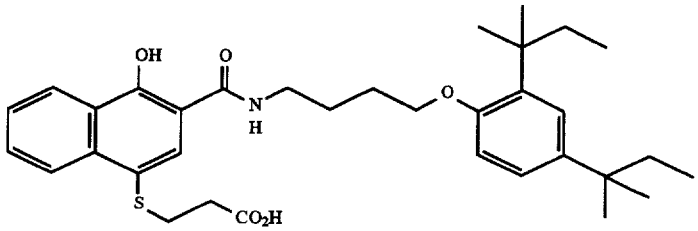

B-2

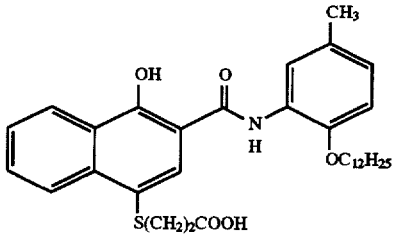

C-1

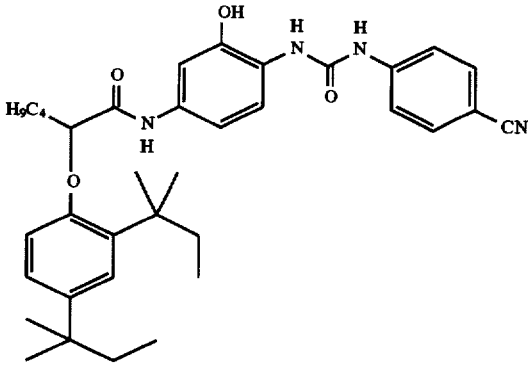

CS-1

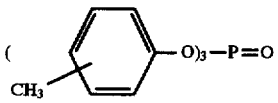

-continued
CS-2
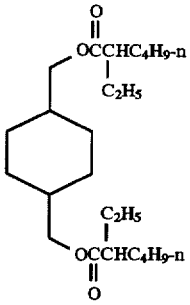
CS-3
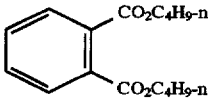
CS-4
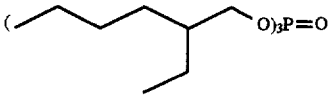
DIR-1
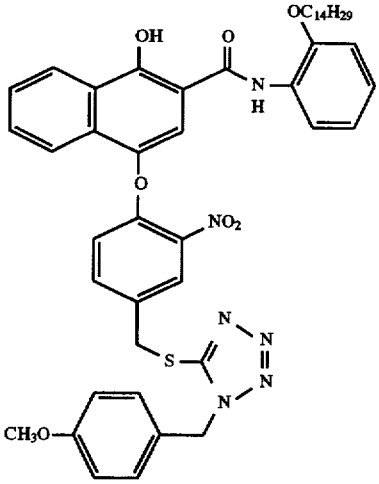
DIR-2
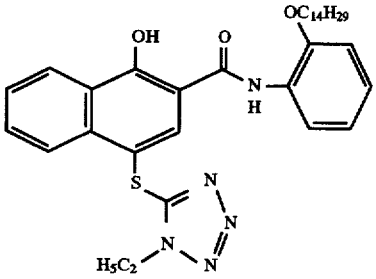

-continued
DIR-3
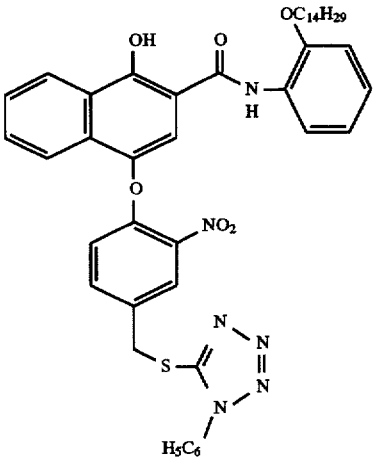
DIR-4
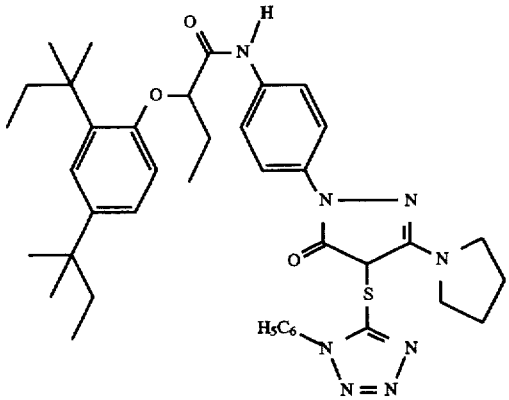
DIR-5
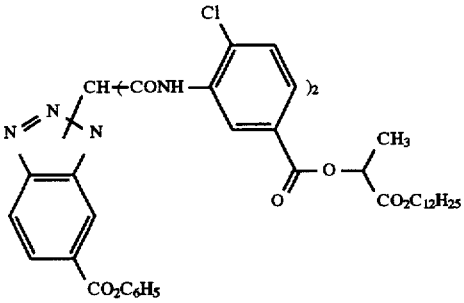
DIR-6
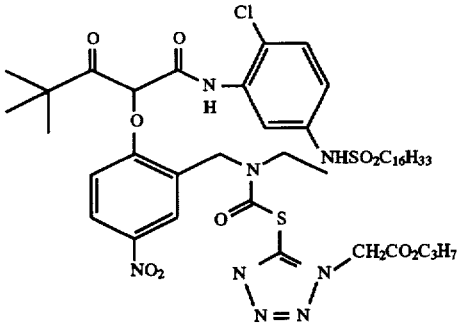

-continued
DIR-7
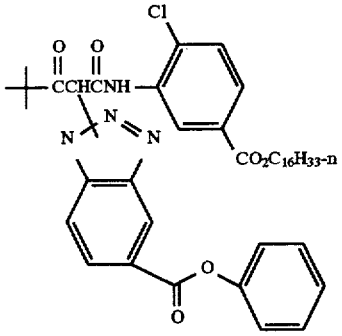
DYE-1
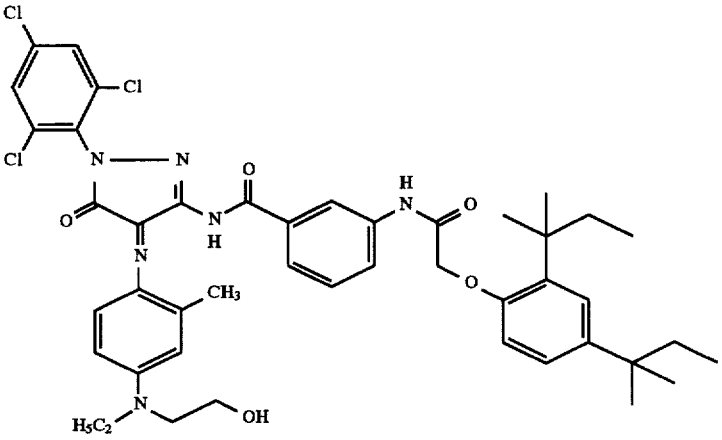
DYE-2
(D-2)
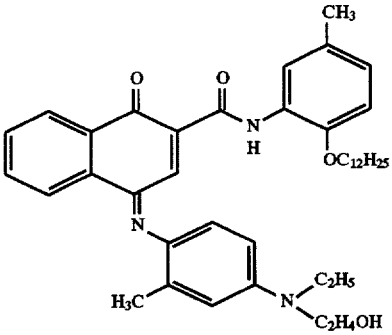
DYE-3
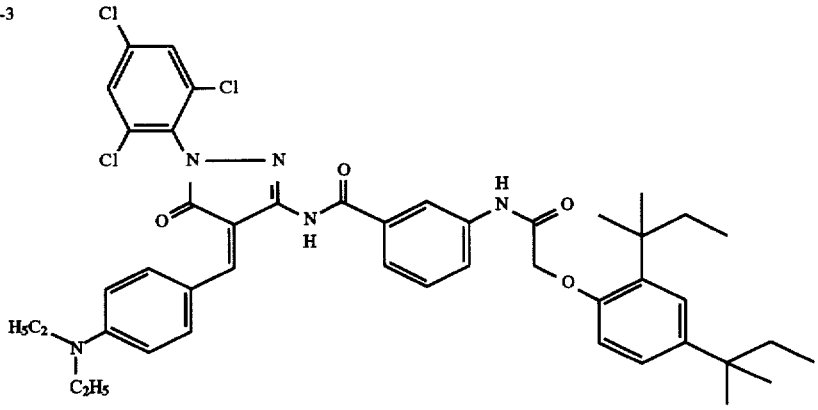

-continued
DYE-4
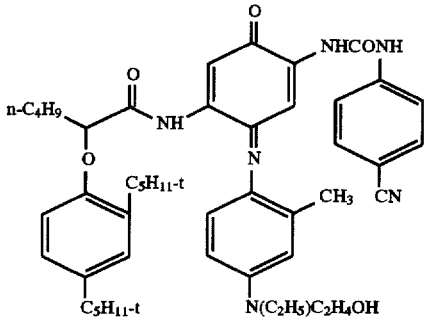
DYE-5
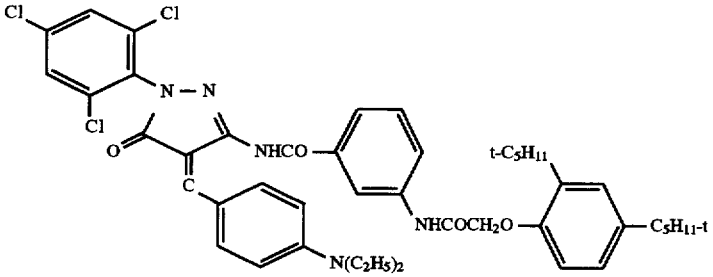
DYE-6
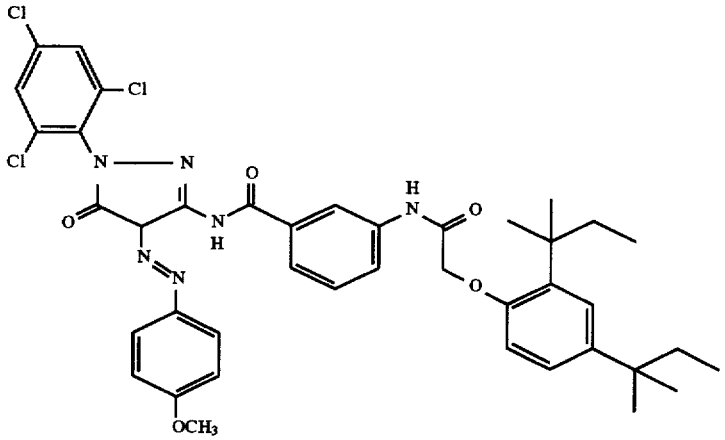
M-1
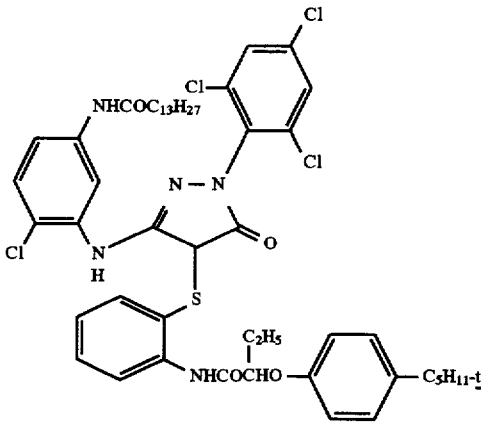

-continued
MC-1
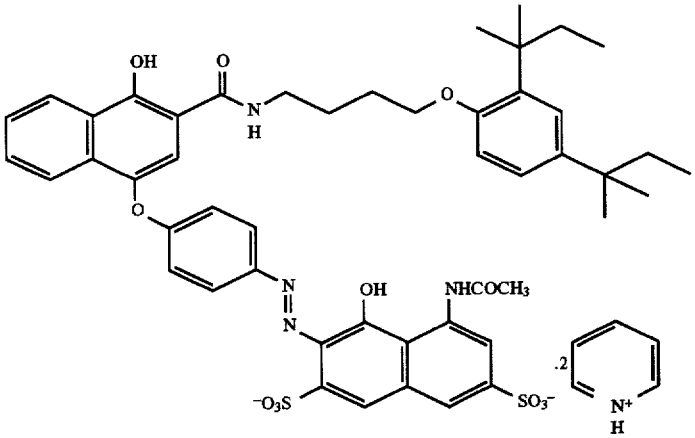
MC-2
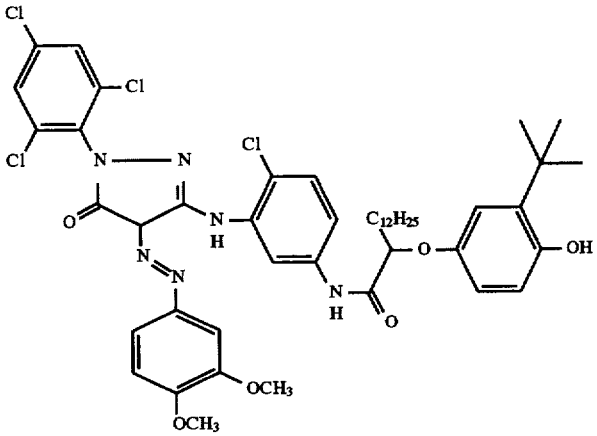
O-1
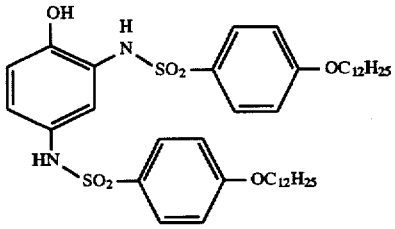
O-2
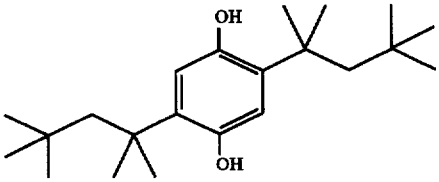
UV-1
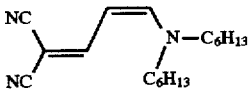
UV-2
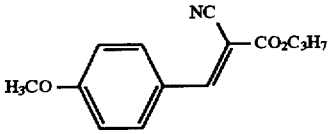

-continued
Y-1
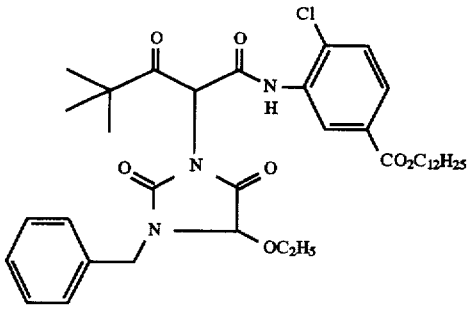
Y-2
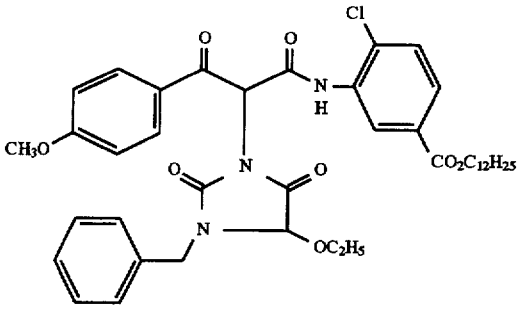
Y-3
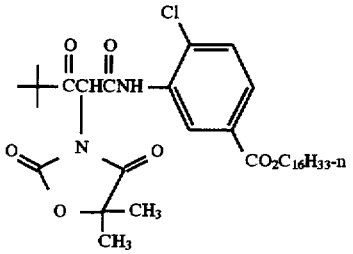
YD-A
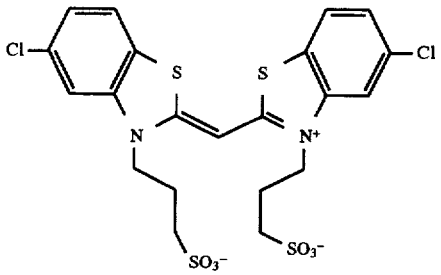
Dye Set 1: CD-A:CD-B at 9:1
Dye Set 2: MD-A:MD-B at 6:1
CD-A:
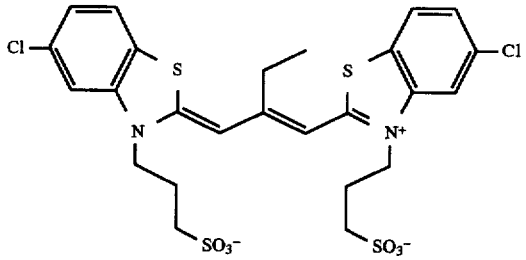

-continued

CD-B:

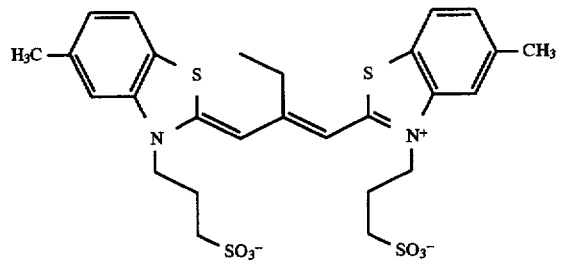

The entire contents of the various patent applications, patents and other publications referred to in this specification are incorporated herein by reference.

What is claimed is:

1. A multilayer silver halide color negative photographic element comprising in the same layer a cyan dye of formula (I) and a ballasted stabilizer compound of formula (II), where the respective formulas are:

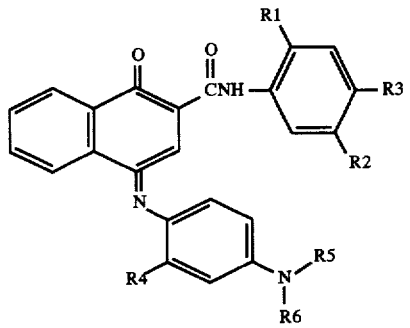

(I)

wherein:

R1 is selected from the group consisting of an alkoxy group, a phenoxy group and a halogen atom;

R2 is selected from the group consisting of hydrogen, an alkyl group, a phenyl group; a halogen atom, an alkoxy carbonyl group of formula —COOR7, and a carbonamido group of formula —NR8COR7;

R3, R4, R5 and R8 are independently selected from the group consisting of hydrogen and an alkyl group;

R6 is an alkyl group; and

R7 is an alkyl group or a phenyl group;

and

B—L—A—R (II)

wherein:

B is a ballast group;

L is a divalent linking group;

A is a group of the formula:

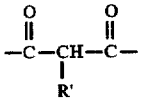

(III)

wherein

R' is hydrogen or an alkyl or alkoxy group; and

R is hydrogen or an aliphatic or aromatic group linked directly or through a nitrogen or oxygen atom to A.

2. The element of claim 1 wherein R is selected from the group consisting of alkyl, aryl, alkoxy, aryloxy, alkylamido, arylamido groups.

3. The element of claim 2 wherein R is an alkyl group.

4. The element of claim 3 wherein the alkyl group is an unsubstituted group.

5. The element of claim 1 wherein B is a group containing at least 6 carbon atoms.

6. The element of claim 1 wherein B comprises a polymeric chain.

7. The element of claim 6 wherein the polymeric chain is a polyalkylene group.

8. The element of claim 7 wherein the polymeric chain is one obtained by polymerizing an acrylate or methacrylate monomer.

9. The element of claim 1 wherein R4 is selected from the group consisting of methyl and sulfonamido ethyl groups.

10. The element of claim 1 wherein L contains and is linked to B by a group selected from the group consisting of —C(O)O—, —C(O)NR'—, —$CH_2$—, —O—, —NR'—, —OR'—, —OR'O—, —C(O)OR'O—, C(O)R'O—, and —C(O)N(R')R"O— wherein each R' is independently hydrogen or an alkyl group and each R" is an independently selected alkyl group.

11. The element of claim 10 wherein L is selected from the group consisting of —C(O)$OCH_2CH_2O$—, —C(O)$OCH_2CH_2CH_2O$—, —C(O)$NHCH_2CH_2CH_2NH$—, —C(O)$OCH_2CH_2NH$—, —C(O)$OCH_2C(CH_3)_2O$—, —C(O)$OCH_2C(CH_3)_2CH_2O$—, —C(O)$NHCH_2CH_2O$—, and —C(O)$OCH_2CH(CH_3)O$—.

12. The element of claim 1 wherein B is a polymer having backbone molecular weight of greater than 1000.

13. The element of claim 6 wherein the polymer is selected from polyvinyl, polyester, polyether, polyurethane, polyamide, polyacrylate, polymethacrylate and copolymers thereof.

14. The element of claim 1 wherein the stabilizer is a polymer in which at least one wt. % of the polymer is derived from repeat units containing —L—A—R.

15. The element of claim 14 in which —L— is selected from the group consisting of —C(O)$OCH_2CH_2O$—, —C(O)$OCH_2CH_2CH_2O$—, —C(O)$NHCH_2CH_2CH_2NH$—, —C(O)$OCH_2CH_2NH$—, —C(O)$OCH_2C(CH_3)_2O$—, —C(O)$OCH_2C(CH_3)_2CH_2O$—, —C(O)$NHCH_2CH_2O$—, and —C(O)$OCH_2CH(CH_3)O$—.

16. The element of claim 14 in which R is an alkyl group.

17. The element of claim 1 wherein R2 is selected from the group consisting of an alkyl group, a phenyl group; a halogen atom, an alkoxy carbonyl group of formula —COOR7, and a carbonamido group of formula —NR8COR7.

18. The element of claim 1 wherein R' is hydrogen.

19. A process for forming a color negative image in the element of claim 1 after the element has been exposed imagewise to light, comprising contacting the exposed element with a color developing agent.

20. The element of claim 1 wherein the color negative element contains a transparent support.

21. A process for forming a positive image after imagewise exposing the element of claim 20 to light followed by developing the element to provide a color negative image, comprising optically printing said color negative image onto a second color negative element.

* * * * *